US009555922B2

(12) United States Patent
Consonni

(10) Patent No.: US 9,555,922 B2
(45) Date of Patent: Jan. 31, 2017

(54) LID FOR CONTAINERS OF SUBSTANCES AND CONTAINER OF SUBSTANCES THUS EQUIPPED

(75) Inventor: Fabrizio Consonni, Vadano Al Lambro (IT)

(73) Assignee: INTERNATIONAL PATENTS AND BRANDS CORPORATION (PA)

( * ) Notice: Subject to any disclaimer, the term of this patent is extended or adjusted under 35 U.S.C. 154(b) by 221 days.

(21) Appl. No.: 13/381,862

(22) PCT Filed: Jul. 2, 2010

(86) PCT No.: PCT/IB2010/001619
§ 371 (c)(1),
(2), (4) Date: Mar. 27, 2012

(87) PCT Pub. No.: WO2011/001273
PCT Pub. Date: Jan. 6, 2011

(65) Prior Publication Data

US 2012/0175371 A1 Jul. 12, 2012

(30) Foreign Application Priority Data

Jul. 3, 2009 (IT) ..... UD2009A0127

(51) Int. Cl.
*B65D 17/34* (2006.01)
*B65D 17/00* (2006.01)

(52) U.S. Cl.
CPC ..... *B65D 17/165* (2013.01); *B65D 2517/0013* (2013.01); *B65D 2517/0029* (2013.01);
(Continued)

(58) Field of Classification Search
CPC ..... B65D 17/165; B65D 2517/007; B65D 2517/0071; B65D 2517/0077; B65D 2517/0013; B65D 2517/0028; B65D 2517/0029
(Continued)

(56) References Cited

U.S. PATENT DOCUMENTS 3,386,613 A 6/1968 Traynor
3,731,836 A 5/1973 Silver
(Continued)

FOREIGN PATENT DOCUMENTS

WO 0058161 A1 10/2000
WO 0102260 A1 1/2001
(Continued)

OTHER PUBLICATIONS

International Search Report and Written Opinion for PCT Application No. PCT/IB2010/001619. European Patent Office. Nov. 5, 2010.

*Primary Examiner* — James N Smalley
(74) *Attorney, Agent, or Firm* — Mannava & Kang, P.C.

(57) ABSTRACT

A- lid (20) for a container (21) comprises: a central surface (27) having a substantially circular shape, on which a line of weakening (30) is made, which defines a closing element (39) which can be opened by pulling, made in the central surface (27); and a drive tab (22), having at least a first end (25) to act as a fulcrum outside the line of weakening (30) connected to the closing element (39) with a rivet (23) and able to be driven so as to remove upward, the closing element (39) from the remaining part of the central surface (27), detaching it along the line of weakening (30). The line of weakening (30) is interrupted at one end of the closing element (39) opposite to the drive tab (22), so that the closing element (39) has a connection flap (34) solid with the remaining part of the central surface (27). In the case of
(Continued)

aluminum, the rivet is located at 1.5-3.5 mm from the front part of the closing element (39). In the case of ferrous allogs, this distance is 4.0-6.0 mm.

13 Claims, 7 Drawing Sheets

(52) U.S. Cl.
CPC ..... *B65D 2517/0071* (2013.01); *B65D 2517/0077* (2013.01)

(58) Field of Classification Search
USPC ..... 220/269, 906, 273; 413/12, 14–16
See application file for complete search history.

(56) References Cited

U.S. PATENT DOCUMENTS

| | | | | |
|---|---|---|---|---|
| 3,795,340 | A | 3/1974 | Hougen et al. | |
| 3,900,128 | A * | 8/1975 | Brown | 220/269 |
| 4,030,631 | A * | 6/1977 | Brown | 220/269 |
| 4,189,060 | A | 2/1980 | Trotman | |
| 4,397,403 | A * | 8/1983 | Guimarin | 220/269 |
| 4,503,989 | A * | 3/1985 | Brown et al. | 220/269 |
| 5,145,086 | A | 9/1992 | Krause | |
| 5,411,159 | A * | 5/1995 | Fan | 220/269 |
| 2007/0131693 | A1 | 6/2007 | Matsukawa et al. | |

FOREIGN PATENT DOCUMENTS

| | | | |
|---|---|---|---|
| WO | 03010054 | A1 | 2/2003 |
| WO | 2009030526 | A1 | 3/2009 |

* cited by examiner

LID FOR CONTAINERS OF SUBSTANCES AND CONTAINER OF SUBSTANCES THUS EQUIPPED

FIELD OF THE INVENTION

The present patent concerns both the lids and also the containers equipped with said lids, and that are normally used to contain liquids, but can also contain solid substances in granular or other form.

In particular, the present invention concerns the lids, and the containers equipped with said lids, in which a closing element, which closes a delivery hole partly affecting the lid, when it is at least partly pulled from the remaining part of the lid of which it is initially an integral part, at no point of the pulling and opening step enters inside the container.

According to the invention, the lid can be made of aluminum or its alloys similar or comparable, or of similar or comparable ferrous alloys.

BACKGROUND OF THE INVENTION

Lids and containers equipped with said lids are known, which are normally used for drinks, or in some cases containers of this type are also used to contain other things.

Said containers are normally substantially cylindrical but they can also have a substantially quadrangular section, extending along the axis perpendicular to said section.

Different experiences are known regarding lids of said known containers, where the delivery hole is obtained by pulling off a very small part of the lid, using a predefined breaking line present in the lid itself.

U.S. Pat. No. 3,731,836 describes a system for opening a closing stopper defined by a closed line of weakening of a can; in this solution, a gripper ring of a lever or tab serves to open the stopper and is located in a substantially central position. The lever has its rotation fulcrum in correspondence with the periphery of the upper wall of the can, whereas in an intermediate position between the gripper ring and the fulcrum there is a rivet type solidarization mean.

A flexible connection element is provided between the gripper ring and the lid of the can and the lever or tab acts on a portion of the can lid outside the closing stopper so that, in the first opening movement, the stopper is lifted and pulled upward and is made to rotate around a pin, with problems relating to time and safety both during the opening step and also when the container is used.

WO 01/02260 describes a system for opening a closing stopper defined by a closed line of weakening of a can, in which the lever or tab, with the relative gripper ring, has its fulcrum on the periphery of the can lid; the gripper ring is central and a rivet, between fulcrum and ring, attaches the opening lever or tab to the stopper.

In this case, since the fulcrum of the lever or tab is in correspondence with the line of weakening that defines the stopper of the can, the action of the lever or tab determines a thrust of the stopper toward the inside, for a first breaking of the line of weakening. Subsequently the lever or tab is used as a traction element to remove the stopper.

This system can put the content in contact with the outside of the tab.

Moreover, this is a system that is dangerous in use.

U.S. Pat. No. 5,145,086 describes a system for opening a closing stopper defined by an open line of weakening of a can, in which the gripper ring of the opening lever or tab is central; the lever or tab has a fulcrum in correspondence with the periphery of the can lid and a rivet is provided which connects the opening lever or tab to the stopper of the can.

The lever or tab acts on a portion of the can lid outside the closing stopper so that, in the first opening movement, the stopper is lifted and pulled upward and is not thrust inside the can.

This solution creates problems of safety for the user, both during opening and when the container is used.

U.S. Pat. No. 3,795,340 describes a system for opening a can in which the lever or tab has a peripheral fulcrum and a central gripper ring.

The stopper of the can occupies a large part of the upper wall thereof, and is defined by a closed and circular line of weakening which substantially coincides with the circumference of the can.

The lever or tab acts inside the closed and circular line of weakening so that, at a first opening movement, the stopper is thrust inside and subsequently is completely removed through traction.

This system too can put the content in contact with the outside of the tab.

Moreover, in this case too, this is a system that is dangerous in use.

U.S. Pat. No. 4,189,060 describes a system for opening a can in which the lever or tab is used to pull off the stopper of the can in a traditional way.

The gripper ring of the lever is normally in a central position; the relative fulcrum of the lever is peripheral.

The rotation of the lever does not cause, as in the prior art documents described above, a portion of the closing stopper to break, but only serves to dispose the lever in an operating position, which lever is then driven, causing the closing stopper to be pulled in correspondence with the protuberance of the aperture.

A connection element comprising a flexible part is provided to connect the lever to the can lid, also in the open position.

This system is not only complex, but also requires a considerable effort. It is also dangerous to use.

U.S. Pat. No. 3,386,613 has a fork-type lever in which the rivet is connected rotatably on a front segment of the lever. This teaching does not allow to obtain a focused point where the force to pull off the stopper can be applied. Furthermore, it provides a mechanical hinge which prevents any support of the front fulcrum in proximity with the start of breaking, since it does not allow to contain the length of the lever, making it difficult to start the breaking.

US 2007/0131693 has a line of breaking that develops along the periphery of the lid; moreover it is the tab which, with its front part, starts the breaking. Additionally, a part of the opening mechanism enters inside the container.

WO 03/010054 provides a tab that starts the opening from a position located inside the lid and extends it until the stopper is completely detached from the lid.

WO 00/58161 provides a stay-on tab in which the stopper penetrates inside the container.

The present invention, advantageously but not exclusively directed to characterize the lids of containers for drinks, has set itself the purpose of overcoming the limits of known solutions and of achieving a system that entails new and unexpected advantages.

Its purpose is also to improve and perfect the inventive idea set forth in WO 2009/030526.

SUMMARY OF THE INVENTION

The present invention is set forth and characterized in the independent claims, while the dependent claims describe variants.

The purpose of the invention is to achieve a system in which a closing element, or stopper, of a limited size with respect to the lid, can be partly detached from the lid easily and without effort. The purpose is also to prevent the stopper from entering inside the container, even temporarily, since it immediately begins to be lifted with respect to the surface of the lid.

According to a variant of the system, once the hole is open, the closing stopper and a relative drive tab remain inside the perimeter bulk of the container, so as to prevent dangers when the container is handled.

The perimeter of the stopper is defined by a line of breaking, or weakening, of a known type, already present in the lid.

The drive tab or lever is of a known type, with an association tab with a flexible portion, solid with the tab; the association tab is made solid with the element that functions as a stopper by means of a rivet or suchlike.

According to the invention, the gripper part of the drive tab faces toward the center of the lid, whereas the front part, functioning as a fulcrum, or first end, is located in direct cooperation with the edge of the substantially flat central surface of the lid. According to the invention, the central surface can also be slightly rounded.

In this way the fulcrum cooperates with the peripheral curb of the central surface which functions as a contrasting part to the force that is applied on the fulcrum, that is, preventing any increase in force or other due to flexions of the central part of the lid.

According to a variant, a reinforcement, stabilization and stiffening ridge is provided by leveling the surface where the front part (fulcrum) of the drive tab acts. Said reinforcement, by further stiffening the point where the fulcrum acts, improves the behavior of the tab. Furthermore, by creating a zone, even minimal, where the fulcrum operates, it reduces the need for precision.

According to a variant, the ridge is obtained by minting.

By acting upward on the tab, on the gripper part present toward the inside of the lid, a lever is generated which transforms said action into an action of pulling upward the element that constitutes the stopper, and therefore said element never enters inside the container.

According to the invention, the pulling action begins substantially on the axis of the drive tab and in close proximity to the connection riveting between flexible portion and the stopper element. Advantageously, the start of breaking occurs at a distance comprised between 1.5 and 3.5 mm from the axis of the rivet, preferably around 2.0 and 2.5 mm, so as to maximize the action of the lever and to reduce to a minimum the pulling force.

According to a variant, in the zone where pulling begins an area is provided in which the thickness of the material that makes up the lid is reduced, for example by means of compression, so as to further reduce the force required for the start of breaking-lifting.

According to another variant, near the zone where the breaking-lifting starts, the stopper has a conformation that extends toward the fulcrum, creating a concentrator segment that facilitates the start of the pulling/breaking, further reducing the necessary force.

According to a variant, the stopper extends toward the center of the lid, and possibly beyond, by means of a connection flap which is also defined by known engraving means, in continuity with the stopper. The connection flap serves to keep the combined stopper-drive tab anchored to the lid.

According to the invention, the stopper can have a substantially round, oval, drop shape etc., as this is irrelevant for the purposes of the invention.

According to the invention, the stopper is made inside a zone consisting of a peripheral reinforcement deformation defined by a reinforcement edge. Consequently, by making said zone with the attached reinforcement peripheral deformation, the deformed surface is stabilized, leveling it and stiffening it. The zone comprised in the reinforcement edge can also be made with an action of minting in order to obtain an increased stiffening and leveling that stabilizes the material.

The central surface of the lid is connected to the stopper by means of the connection flap, by means of a neck of the stopper. The connection flap can have its lateral edges parallel, or as opposite Ws, or again as upside-down and opposite Cs.

According to a variant, near the neck a reinforcement is provided, obtained by deforming the plane, in order to keep a thin connection between the tab and the stopper at the same time preventing breakages in the event of opening and/or use.

According to another variant, the rear part of the connection flap has respective elasticizing connections which branch off in opposite directions and which facilitate the re-use of the stopper.

According to another variant, the elasticizing connections are found, with respect to the reinforcement deformation, in cooperation with it and/or inside it.

According to another variant, the elasticizing connections are found, with respect to the reinforcement deformation, outside it.

According to another variant, the elasticizing connections are found in proximity with the reinforcement edge.

The reciprocal position of the elasticizing connections and reinforcement edge allows to choose, on each occasion, the degree of opening and elasticization desired.

According to another variant, a reinforcement deformation is provided in the stopper, so as to render it non-deformable.

According to the invention, having defined (in millimeters) as 47 the diameter (Ø) of the substantially flat, or slightly rounded, central surface of the lid, the invention provides the following comparative values (in millimeters) (see FIGS. 4 and 4*a*):

- the distance (a) of the part farthest forward of the concentrator segment with respect to the edge of the lid is comprised between 4 and 7, advantageously between 5 and 6, so as to exploit the rigidity created by the peripheral curb, reducing or cancelling flexion;
- the distance (b) between the center of the riveting and the edge which, in the case of aluminum, its alloys or similar, is comprised between 6 and 9, advantageously between 6.5 and 8.5, whereas in the case of a ferrous alloys and similar it is comprised between 9.0 and 11.0, so as to keep the rivet as close as possible to the concentrator segment in order to reduce force required; consequently, the differential (b-a) is comprised, in the case of aluminum and its alloys, between 1.5 and 3.5, advantageously between 2.0 and 2.5, whereas in the case of ferrous alloys and similar it is comprised between 4.0 and 6.0, advantageously between 4.5 and 5.0;
- the diameter of the body of the riveting (the rivet) is advantageously, in the case of aluminum and its alloys, comprised between 2.5 and 3.5, whereas in the case of ferrous alloys and similar it is comprised between 6.0 and 10.0;

the distance of the neck of the edge (c) is comprised between 20 and 33, advantageously between 24 and 28 so as to achieve an exit compartment for the liquid, with sizes such that the exit can be controlled;

the distance between the part farthest from the edge or peripheral curb and the elasticizing connections from the edge (d) is comprised between 25 and 40, advantageously between 30 and 36 so as to keep everything, when the stopper is open, inside the bulk of the container;

the minimum width of the connection flap (e) is comprised between 4 and 10, advantageously between 6 and 8 so as to have a good control of the elasticity;

the maximum width of the stopper (f) is comprised between 15 and 30, advantageously between 18 and 25;

the maximum width of the reinforcement deformation (g) is comprised between 20 and 40, advantageously between 25 and 31 so as to obtain a precise control of the deformation and the connected advantages.

BRIEF DESCRIPTION OF THE DRAWINGS

These and other characteristics of the present invention will become apparent from the following description of some preferential forms of embodiment, given as a non-restrictive example with reference to the attached drawings wherein.

DETAILED DESCRIPTION OF SOME PREFERENTIAL FORMS OF EMBODIMENT

Figure 3:
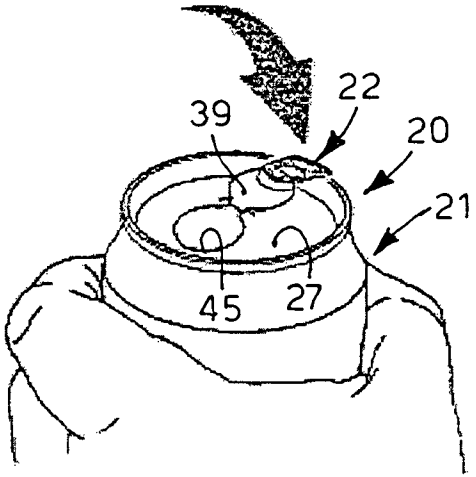
FIG. 3 is a schematic view of the container in FIG. 1 in an open condition.
Figure 2:
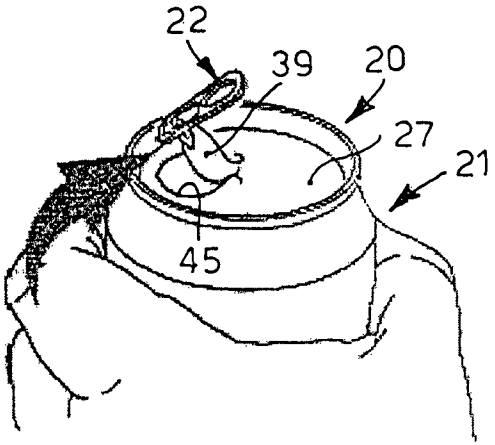
FIG. 2 is a schematic view of the container in FIG. 1 in a subsequent opening step.
Figure 1:
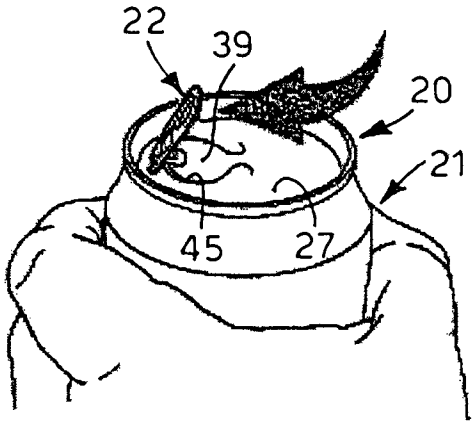
FIG. 1 is a schematic view of a container according to the present invention with the lid in a partly closed condition.

With reference to FIGS. 1, 2, 3 and 4, a container 21 for substances, in this case drinks, is shown in its entirety, and is made for example of aluminum, steel or their alloys, and has a substantially cylindrical shape with an external lateral surface 40, a lid 20 and a bottom, of any known type, and not shown in the drawings.

Figure 4:
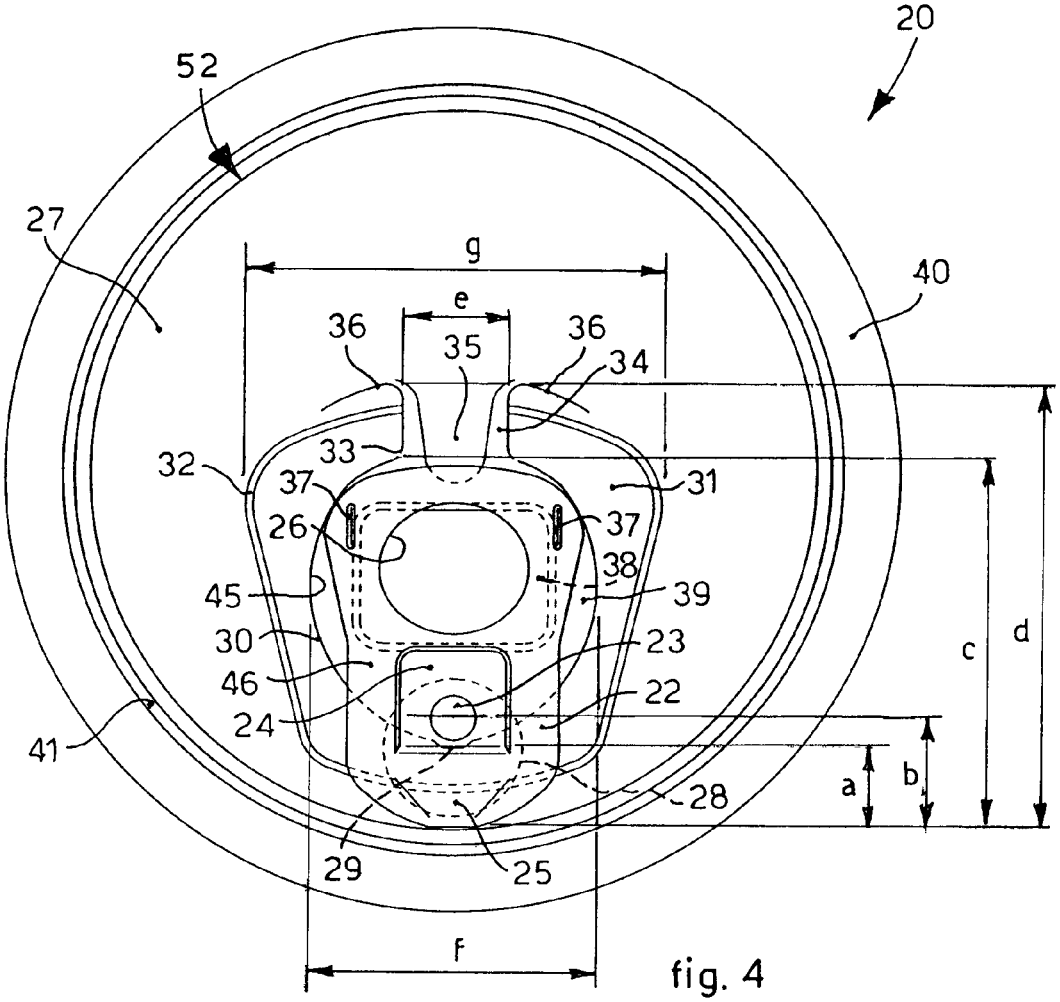
FIG. 4 is a plane view of a lid according to the present invention.
Figure 4A:
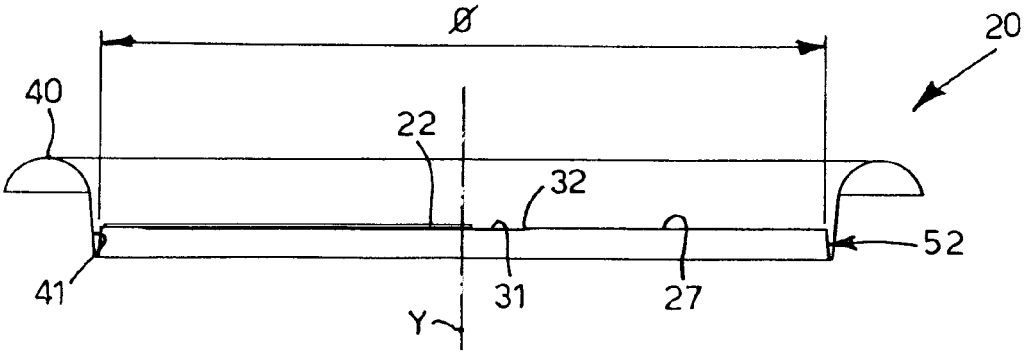
FIG. 4*a* is a schematic view of a cross section of the lid in FIG. 4.

The lid 20 has a substantially circular shape, concentric with respect to a central axis Y of the container 21 (FIG. 4*a*), and has an annular shaped peripheral rib 41 which surrounds a central surface 27 having a determinate diameter "Ø" and defining a peripheral curb 52.

In alternative solutions, the central surface can be provided completely or at least partly flat, or rounded.

On the central surface 27 a line of weakening 30 (FIGS. 4-14) or incision is made in a known manner, having an open configuration, with a locally reduced or variable cross section, which delimits a closing element or stopper 39, having a circular, oval or drop shape.

In the case shown here, the stopper 39 has centrally a reinforcement deformation 38, substantially quadrangular in shape and able to define a greater rigidity of the stopper 39, to promote and guide in a desired manner the steps in which the stopper 39 is detached from the central surface 27 along the line of weakening 30.

In this case, the line of weakening 30 has at the front part a concentrator segment 29, which has a tapered conformation with respect to the profile of the stopper 39 of the line of weakening 30.

The concentrator segment 29, that is, where the break starts and from where it spreads, allows to concentrate, as will be explained in more detail hereafter, the opening action exerted by the user, to facilitate the pulling of the stopper 39 and hence the opening of the corresponding delivery hole 45.

In fact, since the stopper 39 is normally continuous with the lid 20, it closes the corresponding delivery hole 45 through which the drink can come out of the container 10.

In particular, when the container 21 is closed, the stopper 39 closes the hole 45 completely and hermetically, whereas when the container 21 is open (FIG. 3), it is raised, at least partly, from the hole 45, although it remains solid with the remaining part of the container 21, substantially inside the central surface 27.

The stopper 39, as will be shown in detail hereafter in the description, is attached solidly to a drive tab 22 which, in the closed condition, at least partly overlaps it.

The drive tab 22 is drivable manually, by means of a gripper end or ring 26, to separate the stopper 39 from the rest of the lid 20, along the line of weakening 30 or pre-cutting.

On the drive tab 22, in opposite lateral positions with respect to the ring 26, reinforcement ribs 37 can be provided, which also allow to make the drive tab 22 solid with the lid 20, in such a way that it can easily be eliminated. The drive tab 22 has its fulcrum in the front part 25 (FIG. 4) disposed substantially in cooperation with the peripheral curb 52.

The peripheral curb 52 has at least a vertical or subvertical edge, so as to generate a strong resistance to yield, even only elastic yield.

The drive tab 22 comprises an intermediate zone 46, comprised between the gripper ring 26 and the front part 25, to which a flexible portion 24 is constrained, in turn connected to the stopper 39; the constraint of the flexible portion 24 is provided toward the front part 25.

The intermediate zone 46 is attached by means of a rivet 23 to the stopper 39, in proximity to the concentrator segment 29.

By acting on the gripper ring 26 a rotation of the drive tab 22 is determined around its front part 25. This entails a distancing of its intermediate zone 46 from the central surface 27 (FIG. 1), and a relative partial detachment of the stopper 39 from the central surface 27, starting from the concentrator segment 29, so that the aperture 45 starts to open.

Since the front part 25 and the connection zones between the intermediate zone 46 and the flexible portion 24 and between the flexible portion 24 and the stopper 39 are in close proximity, the drive tab 22 defines an extremely favorable arm that allows, with a limited force, to apply a high angular moment.

Furthermore, the force of the drive tab 22 is applied at a point of application in close proximity to the concentrator segment 29 of the line of weakening 13 and with a rotation toward the outside of the container 10.

Moreover, in correspondence with the concentrator segment 29 an area of reduced thickness 28 is provided, which further facilitates the operations to pull off the stopper 39 from the central surface 27 along the line of weakening 30.

Therefore, as can be seen from the above, it is clear that the force needed to lift the stopper 39 along the line of weakening 30 is much less than in containers with a hygienic stopper, or a stopper opening outward, as known in the state of the art.

A further distancing upward of the drive tab 22 (FIG. 2) allows the stopper 39 to be completely removed from the central surface 27 and to be positioned in a folded configuration (FIG. 3).

The stopper 39 comprises at the rear a connection flap 34, substantially rectangular in shape and contiguous to the stopper 39 itself, defined by a rear part of the line of weakening 30.

The connection flap 34 connects the stopper 39 solidly with the remaining part of the central surface 27, so as to prevent it from detaching from the latter, even in the open condition.

At the rear, the connection flap 34 ends with two elasticizing connections 36, defined by the terminal ends of the line of weakening 30.

The elasticizing connections 36 branch off in opposite directions with respect to a median axis of the connection flap 34.

The connection flap 34 also comprises a central reinforcement 35, which extends substantially from the neck 33 to the elasticizing connections 36, in order to strengthen the connection flap 34 and prevent it from breaking during the opening of the lid 20.

The lid 20 also comprises a reinforcement deformation 31 defined peripherally by a reinforcement edge 32, made on the central surface 27.

In particular, the reinforcement edge 32 is made annularly around the stopper 39, so that the line of weakening 30 is made substantially inside the reinforcement deformation 31.

The elasticizing connections 36, according to the elasticization desired, can be provided outside, inside or in cooperation with the reinforcement edge 32.

In particular, the reinforcement edge 32 can be shaped so that the relative reinforcement deformation 31 is lying on a lowered (or raised) plane with respect to the plane on which the central surface 27 lies, so as to resist with greater effectiveness the action of upward traction, needed to remove the stopper 39.

In this way, the possible deformations of the central surface 27 are reduced to a minimum, during the opening of the stopper 39.

Figure 5:
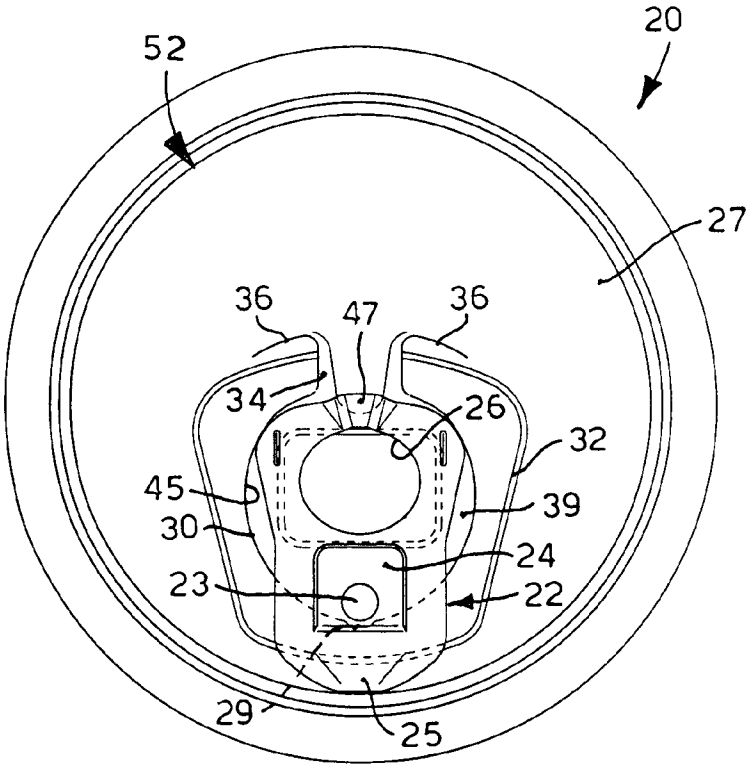
FIG. 5 shows a first variant of the lid in FIG. 4.

In the form of embodiment shown in FIG. 5, the lid 20 has a conformation substantially equivalent to the one shown in the form of embodiment in FIGS. 1-4, except for the ring 26 of the drive tab 22.

In fact, in this form of embodiment, on the rear part of the ring 26 a gripper bridge 47 is provided, raised upward with respect to the rest of the drive tab 22 and able to facilitate the insertion of the tip of the user's finger and/or nail between the drive tab 22 and the central surface 27, to start lifting the drive tab 22 and lift the stopper 39.

Figure 6:
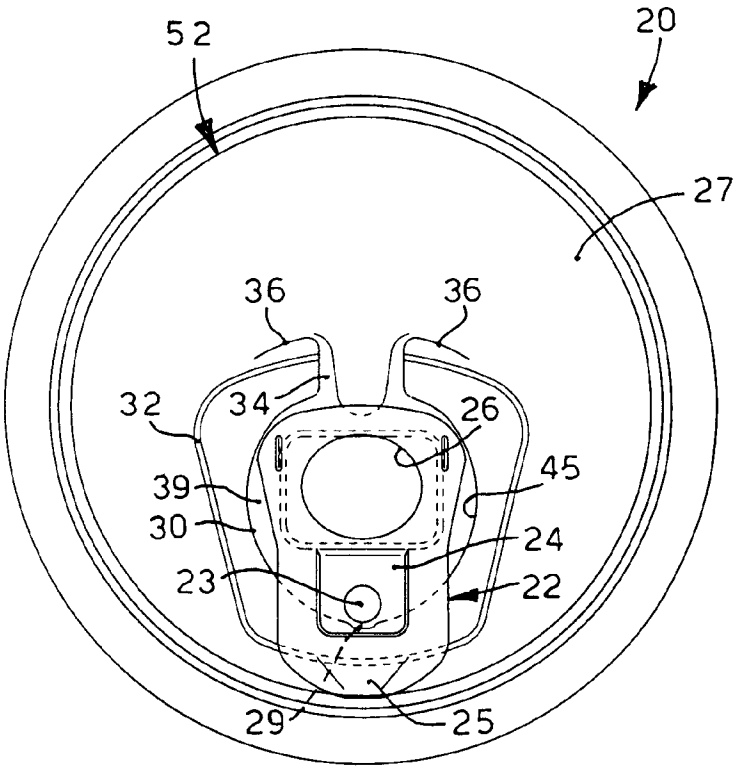
FIG. 6 shows a second variant of the lid in FIG. 4.

In the form of embodiment shown in FIG. 6, the lid 20 has a conformation substantially equivalent to the one shown in the form of embodiment in FIGS. 1-4, except for the flexible portion 24, which, in this solution, is constrained to the intermediate zone 46 toward the gripper ring 26.

In this solution, the mechanical and kinematic conditions of lifting the stopper 39 are partly changed following the lifting of the drive tab 22. Consequently, the conditions of breaking the concentrator segment 29 and the line of weakening 30 are also different from the solutions in FIGS. 1-4 and FIG. 5.

Figure 7:
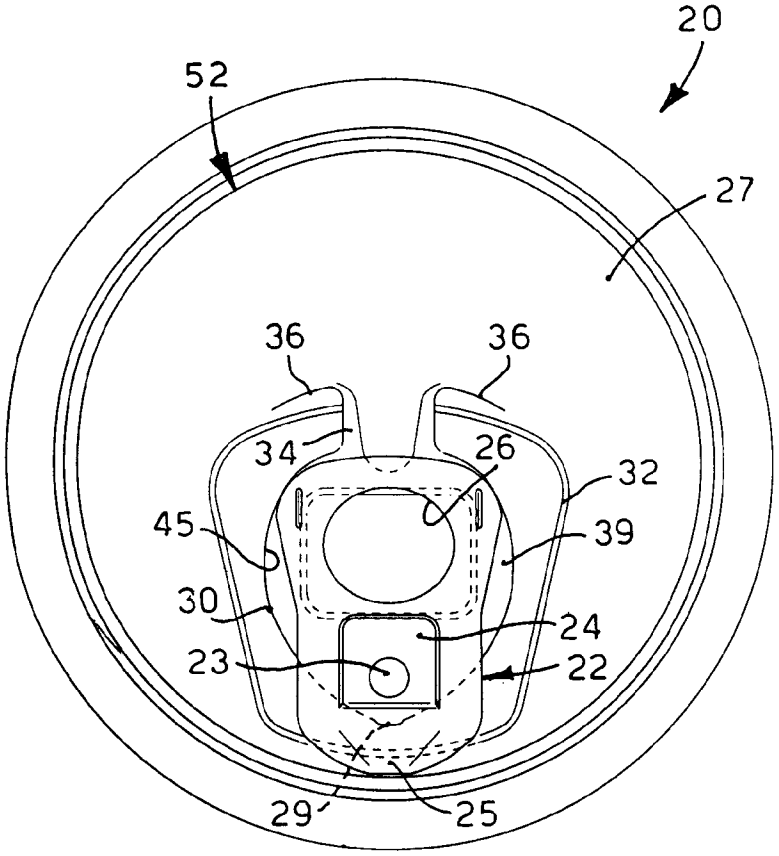
FIG. 7 shows a third variant of the lid in FIG. 4.

In the form of embodiment shown in FIG. 7, the lid 20 has a conformation substantially equivalent to the one shown in the form of embodiment in FIGS. 1-4, except that the distance "b" between the center of the rivet 23 and the front part 25 of the drive tab 22 is at its maximum extension, distancing itself from the concentrator segment 29.

In this solution too, unlike in the solutions in FIGS. 1-4 and FIG. 5, the mechanical and kinematic conditions of lifting the stopper 39 are partly changed following the lifting of the drive tab 22 and consequently, the conditions of breaking the concentrator segment 29 and the line of weakening 30 are also different.

Figure 8:
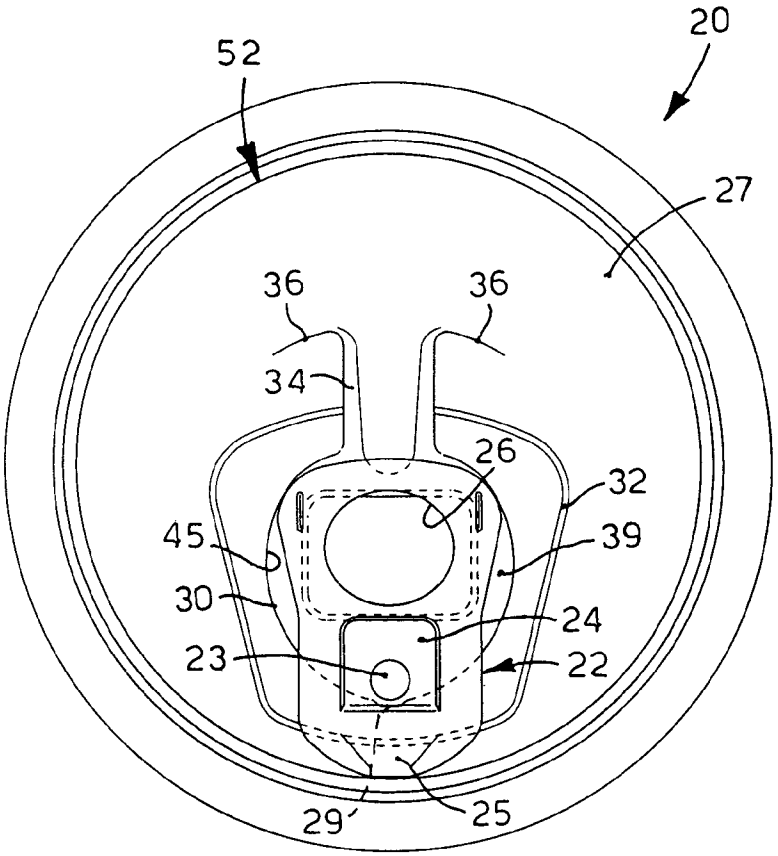
FIG. 8 shows a fourth variant of the lid in FIG. 4.

In the form of embodiment shown in FIG. 8, the lid 20 has a conformation substantially equivalent to the one shown in the form of embodiment in FIGS. 1-4, except that the connection flap 34 has a more elongated conformation, thus also increasing the distance "d" between the elasticizing connections 36 and the front part 25 of the drive tab 22. The elasticizing connection 36 also functions to prevent the break from advancing during opening.

Figure 9:
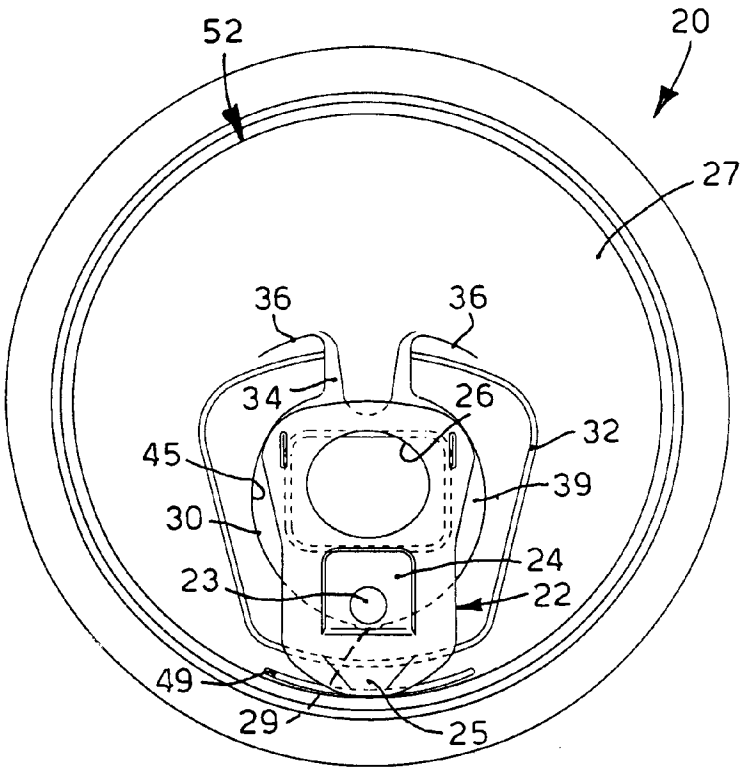
FIG. 9 shows a fifth variant of the lid in FIG. 4.

In the form of embodiment shown in FIG. 9, the lid 20 has a conformation substantially equivalent to the one shown in the form of embodiment in FIGS. 1-4, except that close to the peripheral rib 41, in correspondence with the zone of the central surface 27 on which the front part 25 of the drive tab 22 pivots, a ridge 49 is made, facing upward.

In this solution, the front part 25 rests in direct contact on the ridge 49, so as to discharge the pressure onto the latter during the opening steps. In this solution, the central surface 27 is further preserved from possible deformations due to the pressures at work.

Figure 10:
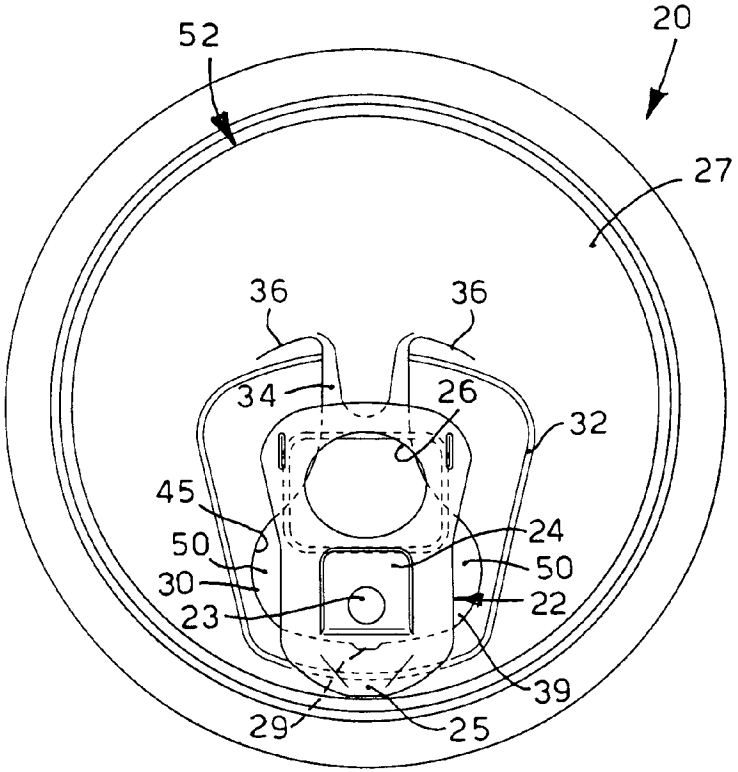
FIG. 10 shows a sixth variant of the lid in FIG. 4.

In the form of embodiment shown in FIG. 10, the lid 20 has a conformation substantially equivalent to the one shown in the form of embodiment in FIGS. 1-4, except that the line of weakening 30 which delineates the shape of the stopper 39 has two lateral bulges 50.

The lateral bulges 50 confer on the stopper 39 a laterally elongated conformation which is easier to detach from the central surface 27.

Figure 11:
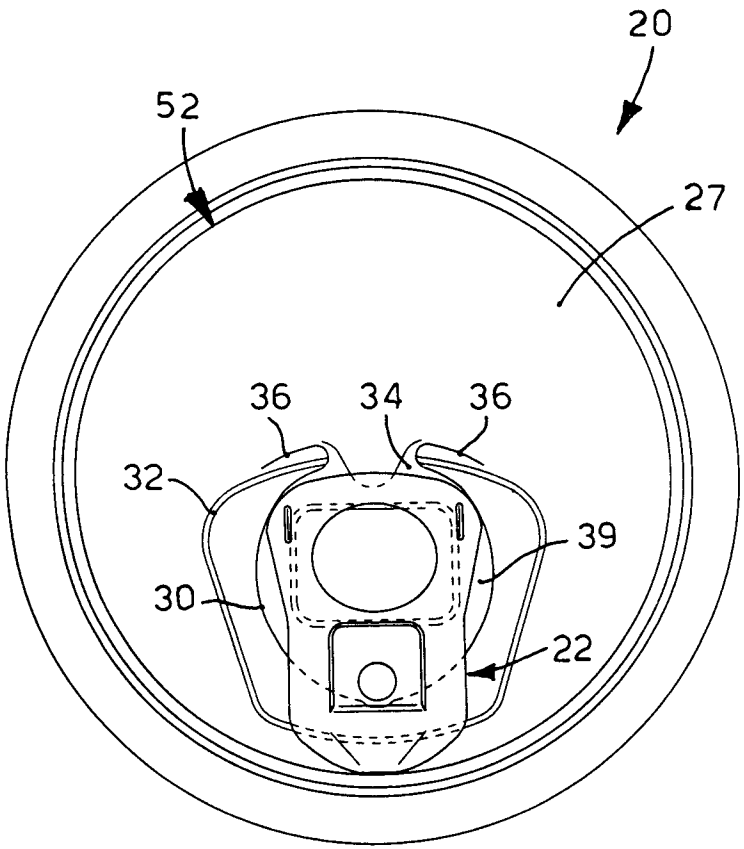
FIG. 11 shows a seventh variant of the lid in FIG. 4.

In the form of embodiment shown in FIG. 11, the lid 20 has a conformation substantially equivalent to the one shown in the form of embodiment in FIGS. 1-4, except that the connection flap 34 has a conformation as short as possible, thus also reducing the distance "d" between the elasticizing connections 36 and the front part 25 of the drive tab 22.

Figure 12:
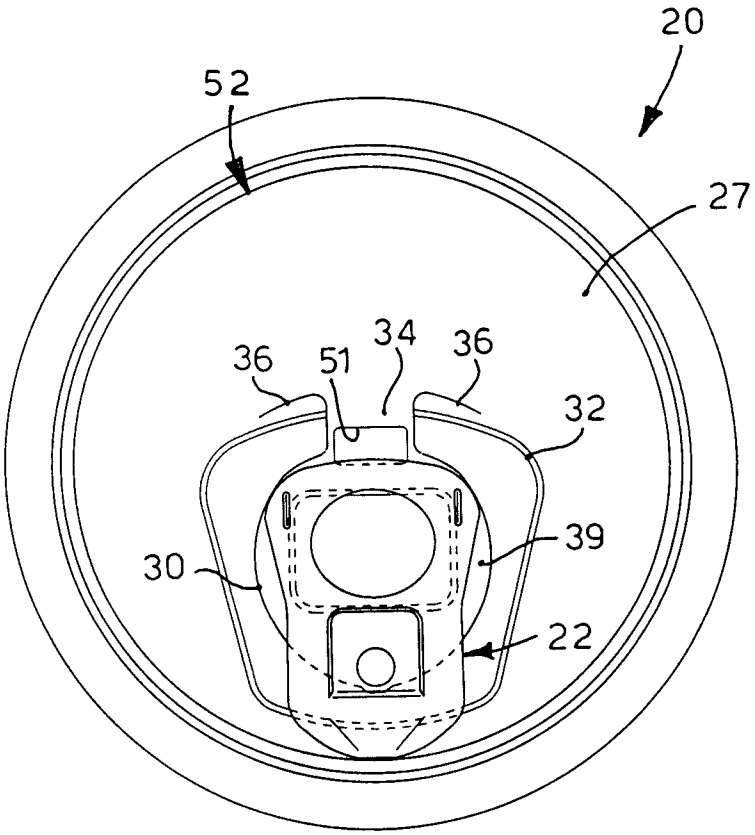
FIG. 12 shows an eighth variant of the lid in FIG. 4.

In the form of embodiment shown in FIG. 12, the lid 20 has a conformation substantially equivalent to the one shown in the form of embodiment in FIGS. 1-4, except that instead of the central reinforcement 35 on the connection flap 34 a gripper seating 51 is made, over which the terminal part of the gripper ring 26 at least partly overlaps.

The gripper seating 51 is conformed to facilitate the insertion of the user's tip of the finger and/or nail between the drive tab 22 and the central surface 27, to start lifting the drive tab 22 and lift the stopper 39.

Figure 13:
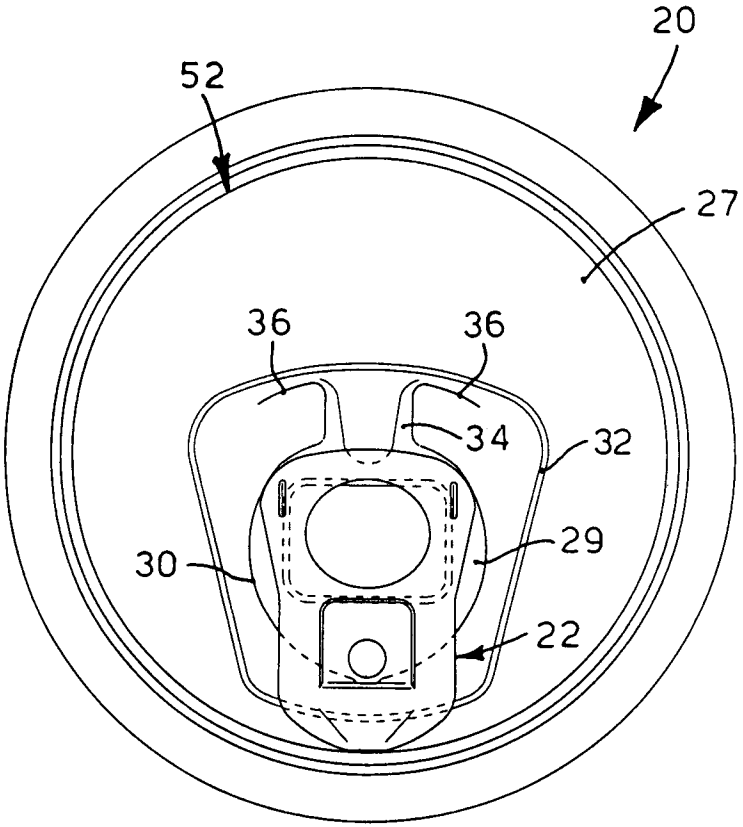
FIG. 13 shows a ninth variant of the lid in FIG. 4.

In the form of embodiment shown in FIG. 13, the lid 20 has a conformation substantially equivalent to the one shown in the form of embodiment in FIGS. 1-4, except that the reinforcement deformation 31 has its reinforcement edge 32 closed and that it extends beyond the elasticizing connections 36, so as to comprise the latter inside the reinforcement deformation 31.

In this way, the possible deformations of the central surface 27 during the opening of the stopper 39 are further reduced.

Figure 14:
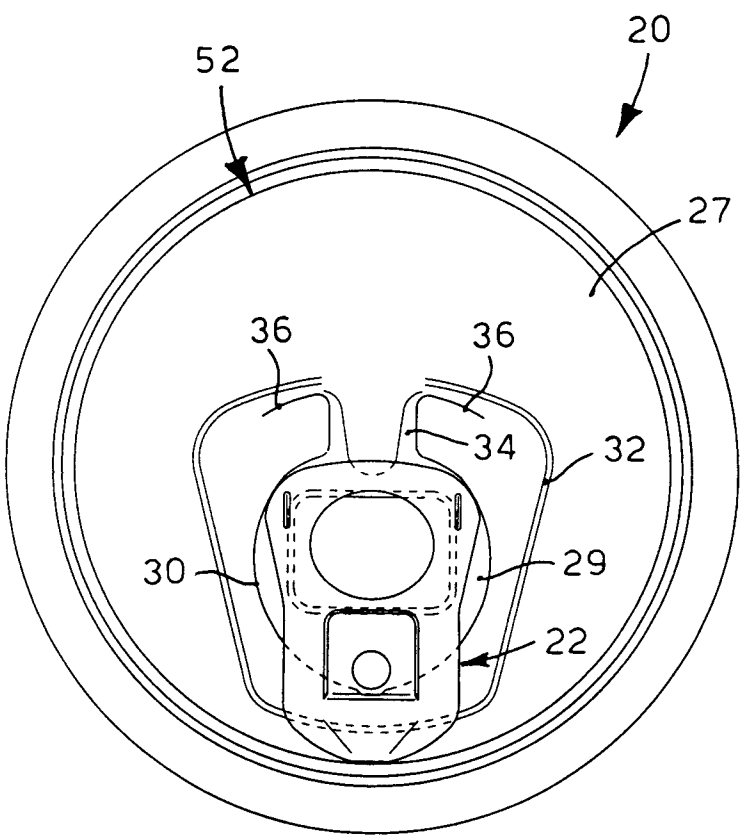
FIG. 14 shows a tenth variant of the lid in FIG. 4.

In the form of embodiment shown in FIG. 14, the lid 20 has a conformation substantially equivalent to the one shown in the form of embodiment in FIG. 13, except that the reinforcement deformation 31 has its reinforcement edge 32 open and that it extends beyond the elasticizing connections 36, so as to comprise the latter inside the reinforcement deformation 31.

It is clear, however, that modifications and/or additions of parts may be made to the lid 20 and the container 21 as described heretofore, without departing from the field and scope of the present invention.

It is also clear that, although the present invention has been described with reference to specific examples, a person of skill in the art shall certainly be able to achieve many other equivalent forms of lid for containers of substances and container for substances thus equipped, having the characteristics as set forth in the claims and hence all coming within the field of protection defined thereby.

The invention claimed is:

1. Lid for a container able to contain a liquid or powdery substance comprising:

a central surface having a substantially circular shape, concentric with respect to a central axis (Y) of the container, and on which a line of weakening is made, which defines a closing element that is configured to be opened by pulling on the closing element; and a drive tab, having at least a first end able to act as a fulcrum outside said line of weakening and an intermediate flexible portion zone solid with said tab and connected with a rivet to said closing element and able to be driven so as to remove upward said closing element, detaching the closing element along said line of weakening, said line of weakening being interrupted at one end of said closing element opposite to said drive tab, with respect to said central axis (Y), so that said closing element has a connection flap solid with the remaining part of said central surface, wherein the fulcrum of the drive tab is a central part of the first end of the drive tab that cooperates with the edge of the central surface in close proximity to a peripheral curb and wherein the connection flap connects to the central surface by elasticizing connections and the elasticizing connections branch off in opposite directions with respect to a median axis of the connection flap, and an axis of the rivet, in the case of aluminum and its alloys, being located at 1.5-3.5 mm or at 2.0-2.5 mm, whereas in the case of ferrous alloys the axis of the rivet is located at 4.0 and 6.0 mm or between 4.5 and 5.0 mm, from the fulcrum at a front terminal part of the closing element, wherein the fulcrum of the drive tab, the axis of the rivet and the front terminal part of the closing element are conformed as a concentrator segment where a break starts when a force is applied to the drive tab, and the drive tab is configured to apply the force at the axis of the rivet, wherein the central surface comprises at least one area with a reduced thickness along the line of weakening and in the intermediate flexible portion zone, wherein the concentrator segment is on the line of weakening and is in correspondence with the intermediate flexible portion zone where the pulling begins, to reduce the effort needed to pull the closing element; and wherein the connection flap includes an at least partially longitudinal reinforcement deformation, which substantially extends around the closing element, and is defined peripherally by a reinforcement edge, and wherein the reinforcement edge and the line of weakening have substantially different shapes.

2. Lid as in claim 1, wherein in the zone where the fulcrum of the drive tab rests there is a reinforcement ridge.

3. Lid as in claim 1, wherein the stopper type closing element has a reinforcement.

4. Lid as in claim 1, wherein the connection flap also comprises a central reinforcement, which extends substantially from a joining neck between the connection flap and the closing element, for the whole connection flap.

5. Lid as in claim 1, wherein the elasticizing connections are located outside a reinforcement edge.

6. Lid as in claim 1, wherein the elasticizing connections are located inside or in cooperation with a reinforcement edge.

7. Lid as in claim 1, wherein the drive tab has only a single fulcrum.

8. Lid as in claim 7, wherein the fulcrum is located along a longitude of the drive tab.

9. Lid as in claim 1, wherein the drive tab includes reinforcement ribs.

10. Container able to contain a liquid or powdery substance comprising a lateral external surface, a lid and a bottom, in which the lid comprises:

a central surface having a substantially circular shape, concentric with respect to a central axis (Y) of the container, and on which a line of weakening is made, which defines a closing element that is configured to be opened by pulling on the closing element to; and a drive tab, having at least a first end able to act as a fulcrum outside said line of weakening and an intermediate flexible portion zone solid with said tab and connected with a rivet to said closing element and able to be driven so as to remove upward said closing element, detaching the closing element along said line of weakening, said line of weakening being interrupted at one end of said closing element opposite to said drive tab, with respect to said central axis (Y), so that said closing element has a connection flap solid with the remaining part of said central surface, wherein the fulcrum of the drive tab is a central part of the first end of the drive tab that cooperates with the edge of the central surface in close proximity to a peripheral curb and wherein the connection flap connects to the central surface by elasticizing connections and the elasticizing connections branch off in opposite directions with respect to a median axis of the connection flap, and an axis of the rivet, in the case of aluminum and its alloys, being located at 1.5-3.5 mm or at 2.0-2.5 mm, whereas in the case of ferrous alloys the axis of the rivet is located at 4.0 and 6.0 mm or between 4.5 and 5.0 mm, from the fulcrum at a front terminal part of the closing element, wherein the fulcrum of the drive tab, the axis of the rivet, and the front terminal part of the closing element are conformed as a concentrator segment where a break starts when a force is applied to the drive tab, and the drive tab is configured to apply the force at the axis of the rivet, wherein the central surface comprises at least one area with a reduced thickness along the line of weakening and in the intermediate flexible portion zone, wherein the concentrator segment is on the line of weakening and is in correspondence with the intermediate flexible portion zone where the pulling begins, to reduce the effort needed to pull the closing element; and wherein the connection flap includes an at least partially longitudinal reinforcement deformation, which substantially extends around the closing element, and is defined peripherally by a reinforcement edge, and wherein the reinforcement edge and the line of weakening have substantially different shapes.

11. Container as in claim 10, wherein the drive tab has only a single fulcrum.

12. Container as in claim 11, wherein the fulcrum is located along a longitude of the drive tab.

13. Container as in claim 10, wherein the drive tab includes reinforcement ribs.

* * * * *